United States Patent [19]

Berard

[11] 4,355,227

[45] Oct. 19, 1982

[54] APPARATUS FOR THE DESTRUCTION OF MICROFICHES AND THE LIKE

[75] Inventor: Jean-Claude Berard, Saint Chamond, France

[73] Assignee: SEB S.A., Selongey, France

[21] Appl. No.: 32,473

[22] Filed: Apr. 23, 1979

[30] Foreign Application Priority Data

May 8, 1978 [LU] Luxembourg ..... 79621

[51] Int. Cl.³ ..... H05B 3/00

[52] U.S. Cl. ..... 219/390; 219/433; 219/415; 219/386; 241/65

[58] Field of Search ..... 432/1, 9, 13, 226, 254.1; 110/242; 232/1 R, 1 D, 43.2; 219/415, 521, 401, 385, 386, 387, 390, 407, 518, 433; 241/1, 23, 65

[56] References Cited

U.S. PATENT DOCUMENTS

| | | | |
|---|---|---|---|
| 371,842 | 10/1887 | Hewes | 110/242 |
| 1,530,416 | 3/1925 | Saeki | 219/415 |
| 1,581,259 | 4/1926 | Wiechert et al. | 219/386 |
| 1,661,354 | 3/1928 | Ayre | 219/385 |
| 1,762,171 | 6/1930 | Goldsmith | 219/521 |
| 2,281,235 | 4/1942 | Cooper | 432/13 |
| 2,595,411 | 5/1952 | Ripoche | 432/1 |
| 2,640,907 | 6/1953 | Morey | 219/433 |
| 3,115,986 | 12/1963 | Groff | 232/43.2 |
| 3,351,741 | 11/1967 | Shelley | 219/386 |

FOREIGN PATENT DOCUMENTS

| | | | |
|---|---|---|---|
| 2136748 | 1/1973 | Fed. Rep. of Germany | 219/521 |
| 2399278 | 2/1979 | France | 241/1 |

*Primary Examiner*—Bernard Roskoski
*Attorney, Agent, or Firm*—Young & Thompson

[57] ABSTRACT

Microfiches to be destroyed by heat treatment are placed within a disposable tube fitted with a sealing plug, then baked to a sufficient temperature to cause melting and discarded. The apparatus comprises an electric heating resistor and a tubular heating jacket for receiving the disposable tube, the sealing plug being forcibly engaged in the tube by means of a cap which is screwed down by hand. All negative sheets and documents having a photosensitive surface such as microfiches are destroyed economically without any contaminating waste products.

5 Claims, 6 Drawing Figures

APPARATUS FOR THE DESTRUCTION OF MICROFICHES AND THE LIKE

This invention relates to an apparatus for the destruction of microfiches and any similar documents of the type comprising a photosensitive surface for receiving information, especially information relating to bookkeeping. These microfiches have to be destroyed after use by reason of their confidential nature.

The destruction of microfiches presents serious problems. Two known types of equipment have been employed for this purpose up to the present time:

grinding machines which cut the microfiche so as to form fine particles;

chemical units for the use of a bath which dissolves the microfiche by chemical attack.

Devices of these types are costly and therefore cannot be employed economically when the microfiches to be destroyed daily amount only to a small number.

Moreover, waste fragments left by devices of these types are a source of pollution and this presents a problem of waste removal.

The present Applicant has endeavored to utilize different methods of destruction:

mechanical scraping, but this operation does not make it possible to obtain total destruction of information recorded on the microfiche. This is a major drawback, for example in the case of microfiches which bear bank account signatures;

heating by means of a heating press of the waffle-iron type. Experience has shown that the operation results in the production of foul-smelling smoke and that the residues adhere to the heating plates.

The aim of the present invention is to permit economical destruction of microfiches in such a manner as to make these latter wholly illegible without making it necessary to produce contaminating waste material.

In accordance with the invention, microfiches and like documents which have a photosensitive surface coating are destroyed by placing said microfiches within a substantially leaktight chamber and baking them within said chamber at a sufficiently high temperature and for a sufficient period of time to cause at least partial melting of said microfiches.

Preferably, the microfiches are rolled-up around each other so as to form cylinders before being introduced into the chamber and are maintained in a vertical position during the baking operation.

Experience has shown that it is thus possible to obtain complete destruction of microfiches by melting and solidification, with the result that the wad of microfiches is converted to a compact and indecipherable block.

The apparatus for the destruction of microfiches and the like, essentially comprises a tubular jacket equipped with heating means, a tube removably housed within said jacket, said tube being intended to receive the microfiches to be destroyed and fitted with a removable plug, and means carried by the apparatus for ensuring substantially leaktight closure of the tube by means of its plug while baking of microfiches is in progress.

Further distinctive features of the invention will become apparent from the description which now follows, reference being had to the accompanying drawings which are given as examples and not in any limiting sense, and wherein.

Figure 1:
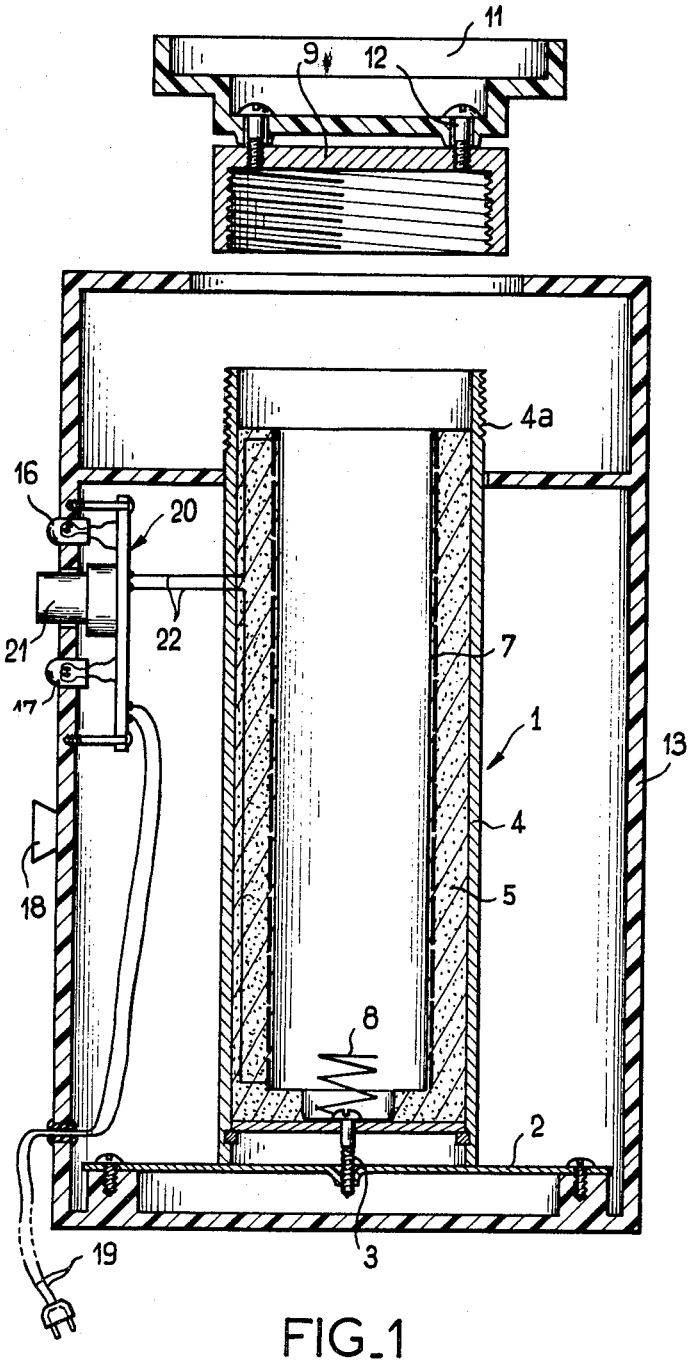
FIG. 1 is a schematic axial sectional view in elevation of the body of an apparatus according to the invention.

The present invention apparatus essentially comprises a tubular heating jacket 1 fixed on a base plate 2 by means of a screw 3, said jacket 1 being thus maintained in a vertical service position.

The heating jacket 1 comprises a cylindrical outer wall 4 surrounding a tubular insulating wall 5 within which is formed an axial housing 6. The internal surface of the wall 5 is lined with a helically wound and flexible electric heating resistor 7. The bottom end of the jacket 1 is fitted with a return spring 8 and the top periphery **4*a* of the wall 4 is threaded so as to receive a metal cap 9 which is intended to be screwed in position by means of a separately mounted handle 11 of heating-insulating material. Said handle is thermally insulated from the cap 9 but rigidly fixed to this latter by means of connecting screws 12**.

The assembly thus formed is housed within an outer cylindrical body 14 of plastic material, for example. Said body is coaxial with the heating jacket 1 and surrounds said jacket at a certain distance from this latter. The body 14 is adapted to carry a small plate 15 on which is formed a printed circuit constituting an electronic programmer or timing unit 20 for carrying out the following sequence of operations:

heating-up of the jacket 1 and backing stage. This stage is indicated by two control lamps 16, 17;

commencement of the cooling period indicated by the single control lamp 17;

end of the operation indicated by extinction of the two control lamps and actuation of a sound warning device shown diagrammatically at 18.

Current is supplied through the leads 19 which terminate in a push-button switch 21. There are also shown at 22 the leads which supply current to the heating resistor 7 under the control of the programming unit 20.

Figure 2:
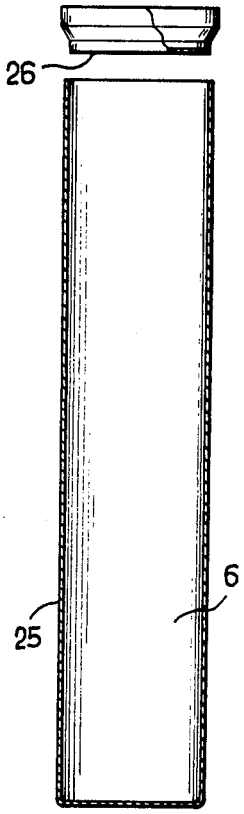
FIG. 2 is an axial sectional view of a disposable tube for the apparatus of FIG. 1.

As shown in FIG. 2, there is associated with the apparatus as thus constituted a disposable tube 25 formed, for example, of very inexpensive extruded aluminum and fitted with a frictionally mounted plug 26 of the same material. By way of example, the dimensions of the tube 25 are such that this latter can accommodate up to six microfiches which are rolled-up together along the axis of the tube.

Moreover, the external diameter of the tube 25 corresponds to the internal diameter of the insulating wall 5 and the height of said tube is greater than that of the wall 4 after the plug 26 has been fitted in position. By way of example, a disposable tube of extruded aluminum for the destruction of five to six microfiches can have a diameter of 25 millimeters, a height of 125 millimeters and a wall thickness of 0.3 millimeter.

Figure 3:
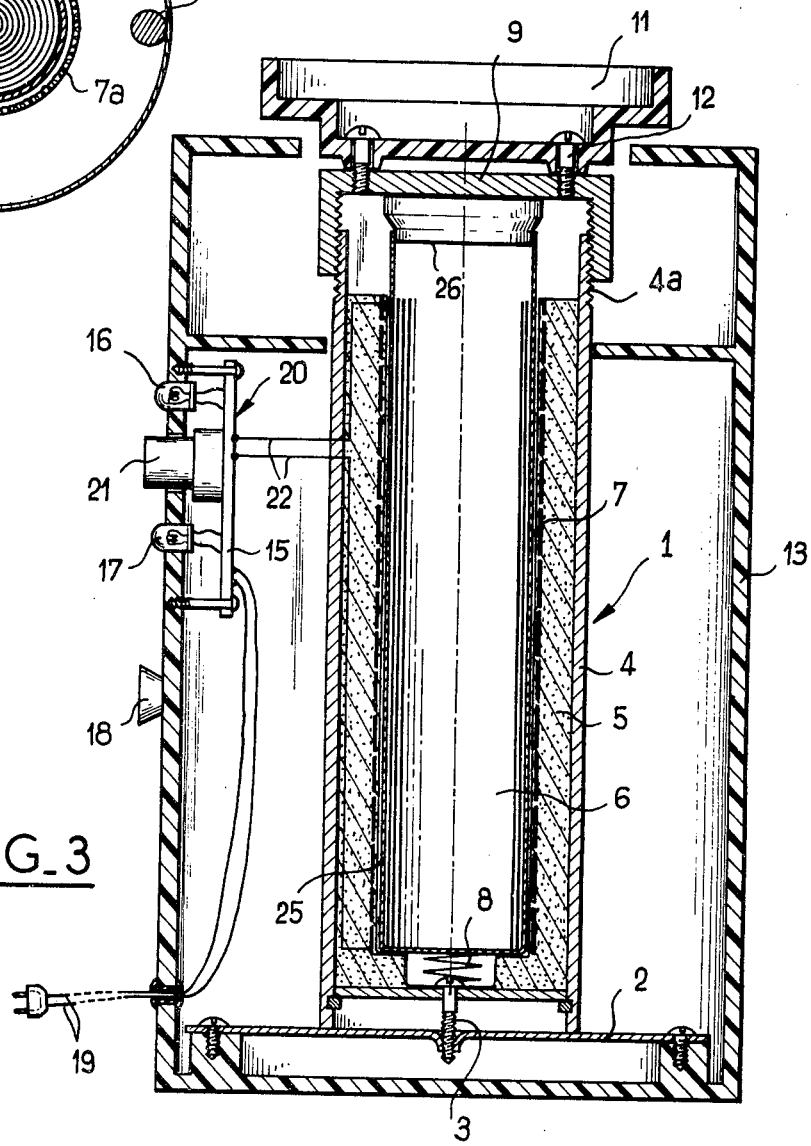
FIG. 3 is an axial sectional view of the apparatus during operation.

The use of an apparatus designed in accordance with the foregoing arrangements is as follows:

when the user has collected the desired number of microfiches 30 to be destroyed in order to fill the tube 25, he rolls them up successively around each other, introduces them into the tube and closes this latter by forcible engagement of the plug 26. The tube 25 is placed in position within the housing 6 of the heating jacket 1, whereupon the cap 9 is screwed onto the threaded portion 4*a* of the wall 4 with the aid of the handle 11. By so doing, the tube 25 is thrust downwards into the housing 6 in opposition to the spring 8 which is thus compressed (as shown in FIG. 3);

the user then depresses the push-button of the switch 21, thus initiating the supply of current to the heating resistor 7. The interior of the tube 25 is then very rapidly heated to a baking temperature which is sufficient to melt the photosensitive material of the microfiches 30. This baking operation takes place in an enclosed atmosphere since the tube 25 is hermetically closed. This is achieved by the friction which prevents withdrawal of the plug 26 and by the combined actions of the cap 9 and of the opposing spring 8 which prevent any opening of the tube 25 under the pressure of gases released by the baking process.

At a temperature which is substantially within the range of 200° to 250° C. and for a period of one minute to three or four minutes, the roll of microfiches 30 is liquefied then converted after cooling to a hard and compact cylinder which no longer permits any deciphering, without any emission of smoke. During the heating operation, the control lamps 16 and 17 are turned-on. After baking, the timing unit 20 cuts-off the supply of current to the resistor 7 but maintains the lamp 17 switched-on for a period of approximately ten minutes which is necessary for cooling the tube 25. At the end of this period, the control lamp 17 is extinguished and the sound warning device 18 is actuated temporarily.

The user unscrews the cap 9, the tube 25 is lifted by the spring 8 and can readily be gripped, the temperature of the tube being such that any potential danger of burning is effectively averted.

The tube 25 is then discarded together with its plug 26 in order to prevent the emission of foul odors whilst the smoke is condensed within the interior of the tube after cooling of this latter.

The apparatus according to the invention is of small volume and can readily be placed on a desk, and can be produced economically whilst the cost price of the tube 25 is in any case negligible.

It has also been shown by experience that maintenance of the tube 25 in the vertical position is a relatively critical factor in the achievement of total destruction of microfiches.

Figure 4:
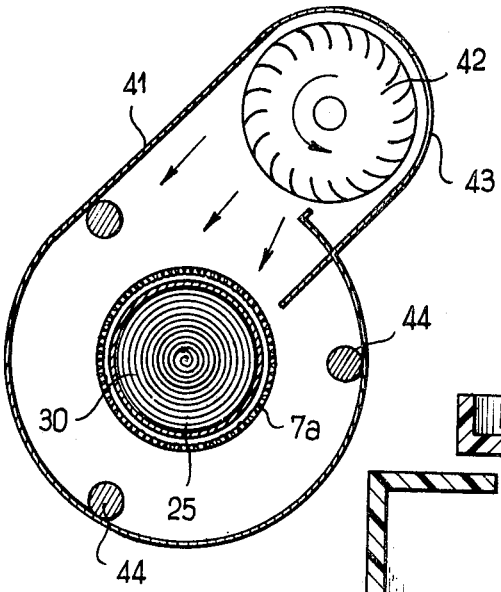
FIG. 4 is a simplified transverse sectional diagram of an alternative embodiment.

It is readily apparent that the invention is not limited to the embodiment hereinabove described and that alternative modes of execution may accordingly be contemplated. In particular, in order to accelerate the cooling process, the layer 5 of insulating material can be dispensed with while retaining only the wall 4 and installing within the body 13 a cooling blower which is controlled by the timing unit 20. A design of this type is shown in FIG. 4. The outer casing 41 houses an impeller 42 which directs a flow of indrawn air through the inlet 43 towards the heating element 7*a* which is not provided with insulating material in this case in order to accelerate the cooling process under the action of the blower. The casing as a whole is maintained by means of columns 44.

Figure 6:
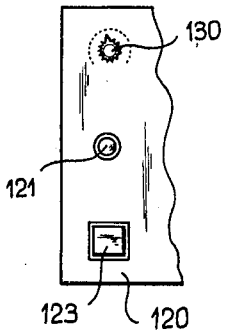
FIG. 6 is a detail view of the same apparatus and looking in the direction of the arrow VI of FIG. 5.
Figure 5:
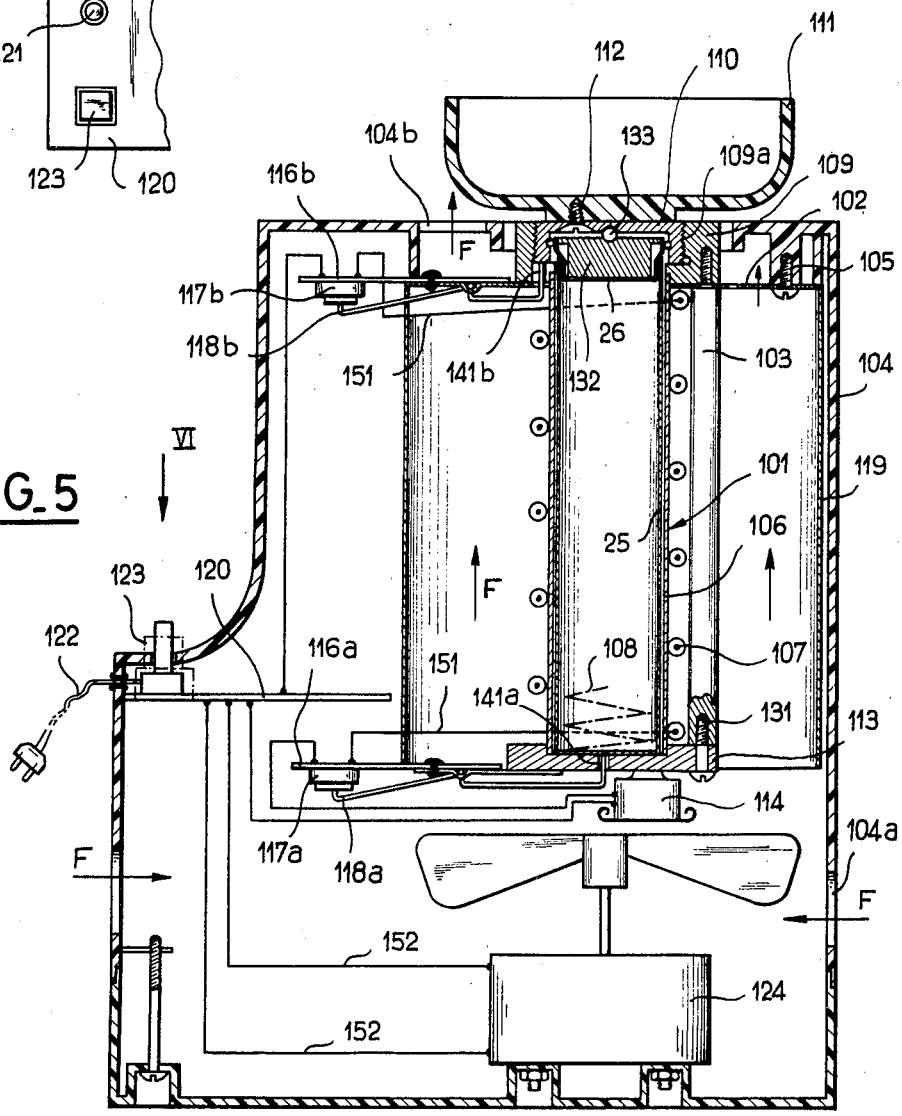
FIG. 5 is an axial sectional view of another embodiment of the apparatus.

Another industrial embodiment which makes use of a fan and comprises a control circuit which is slightly different from the circuit of the first embodiment is shown in FIGS. 5 and 6. In this version, the heating jacket 101 is held in position between a top end-plate 102 pierced by holes and a bottom end component constituted by an aluminum disc 113 provided with a machined recess fitted with a return spring 108, position maintenance of the heating jacket being ensured by means of three small bracing columns 103. The top end-plate 102 is attached to the hollow body 104 of molded material of the apparatus by means of screws 105 whilst the small columns 103 are in turn screwed into a steel ring 109 which is thus secured to the end-plate 102. The small columns 103 are coupled to the recessed disc 113 by means of screws 131.

The heating jacket 101 has a cylindrical wall 106 and a screened heating resistor 107 which is helically wound around said wall. The heating jacket 101 is surrounded by a cylindrical aluminum reflector 119, the design function of which is to prevent excessive heating of adjacent portions.

As in the previous embodiment, the jacket 101 is intended to receive the disposable tube 25 which contains the microfiches and is closed by its plug 26, said plug being provided with a frusto-conical bearing surface having a slope of 3%, for example.

The ring 109 is internally threaded at 109*a* in order to receive a threaded metal cap 110 which is intended to be screwed in position by means of a separately mounted handwheel 111 of insulating material which is thermally insulated from the cap 110 but is rigidly fixed to this latter by means of screws 112. When the apparatus is in service, provision is made beneath the cap 110 for a weight-head 132 on which the cap 110 is intended to be applied by means of an antifriction ball 133. The weight-head 132 is intended to bear on the plug 26 of the tube 25 under the pressure imparted by the cap 110 when this latter is screwed in position within the ring 109 by means of the handwheel 111.

An airscrew fan 124 is mounted beneath the recessed disc 113 on the detachable bottom end-plate of the body 104. The flow of cooling air is admitted through inlet orifices 104*a* and discharged through outlet orifices 104*b* (as shown by the arrows F).

The circuit for supplying current to the resistor 107 as represented schematically by the leads 151 also supplies two safety switches 117*a*, 117*b* which are mounted in series and fixed on small plates 116*a*, 116*b*, said plates being adapted to carry printed circuits and intended respectively to control the correct positioning of the bottom of the tube 25 within the recessed disc 113 and the correct closure of the cap 110.

To this end, the switches 117*a*, 117*b* are controlled by feelers 141*a*, 141*b* which extend respectively through the disc 113 and the ring 109. When they are thrust back, said feelers 141*a*, 141*b* have the effect of closing the switches 117*a*, 117*b* by means of levers 118*a*, 118*b* which are pivotally mounted on the small plates 116*a*, 116*b*.

The switches 117*a*, 117*b* are also mounted in series with a thermostat 114 which is attached to the recessed disc 113 and serves to measure the temperature of this latter.

The leads 151 and the leads 152 for supplying current to the fan 124 terminate in a control printed circuit constituting a sequential system carried by a small plate 120 (as shown in FIG. 6) on which is mounted a push-button switch 123 supplied by a flexible cord 122, an indicator lamp 121 and a potentiometer 130 forming part of an electronic timing device for adjusting the operating time of the fan 124.

The intended functions of the circuit thus established are as follows:

to initiate lighting-up of the control lamp 121 during the period corresponding to a complete operating cycle;

to permit the supply of current to the resistor 107 during a variable period which depends on the temperature attained by the recessed disc 113, said period of time being a function of the number of microfiches which are contained within the tube 25 and are to be destroyed;

to store the opening of the thermostat 114 in memory;

at the time of opening of the thermostat 114, to start-up the fan 124 during the time interval programmed by the potentiometer 130;

and finally to establish the following safety measures which consist:

in preventing start-up of the heating operation if the tube 25 is not placed within the apparatus (the switch 117*a* being open) and /or if the cap 110 has not been screwed down (the switch 117*b* being open);

in cutting-off the supply of current to the resistor 107 if the cap 110 is withdrawn while heating is in progress.

Operation of the apparatus by the user is similar to the procedure described earlier.

What is claimed is:

1. An apparatus for the destruction of microfiches, comprising a tubular heating jacket housed within and spaced from an outer housing, said jacket fixed on a base plate which maintains said jacket in a vertical service position, an axial cylindrical housing formed in said tubular heating jacket, said housing having a cylindrical internal surface on which is mounted an electrical heating resistor, a cylindrical metallic disposable tube removably housed in said housing, the external diameter of said tube corresponding to the internal diameter of said housing, said tube having a size such that it can receive at least one microfiche to be destroyed when rolled up along the axis of the tube, said tube having a leaktight plug for preventing escape of gases generated during the destruction of microfiches, and said jacket comprising a cap which is adapted to be mounted on said jacket for closing said housing and for bearing on the plug of the tube.

2. An apparatus as defined in claim 1, comprising means for directing a flow of cooling air to the tube containing the microfiches after baking of said microfiches.

3. An apparatus as defined in claim 2, said outer housing comprising a hollow body which contains the heating jacket at the upper portion thereof in the service position and which contains a fan at the lower portion thereof, circulation of air within the body being carried out in a substantially axial direction through orifices formed in the wall of said hollow body.

4. An apparatus as defined in claim 1, comprising an electronic timing device for carrying out the following sequence of operations:

heating-up of the heating jacket and baking of the microfiches, cooling of the heating jacket, operation of an end-of-cycle warning device.

5. An apparatus as defined in claim 4, comprising a safety system for preventing the heating operation if the tube containing the microfiches has not been positioned accurately within the heating chamber or if the cap of the jacket has not been accurately mounted in position.

* * * * *